US005987642A

United States Patent [19]

Webster

[11] Patent Number: 5,987,642

[45] Date of Patent: Nov. 23, 1999

[54] PROTECTIVE BATTING GLOVE

[76] Inventor: Charles Harvey Webster, 3834 Janbrook Rd., Randallstown, Md. 21133

[21] Appl. No.: 08/639,554

[22] Filed: Apr. 29, 1996

[51] Int. Cl.[6] ..... A41D 13/10

[52] U.S. Cl. ..... 2/19; 2/20; 2/161.1

[58] Field of Search ..... 2/16, 19, 20, 161.1, 2/159, 160, 161.2

[56] References Cited

U.S. PATENT DOCUMENTS

| | | | |
|---|---|---|---|
| 325,968 | 9/1885 | Rawlings . | |
| 4,042,975 | 8/1977 | Elliott, Jr. et al. | 2/19 |
| 4,094,014 | 6/1978 | Schroeder | 2/161 |
| 4,561,122 | 12/1985 | Stanley et al. | 2/20 |
| 4,691,387 | 9/1987 | Lopez | 2/161 |
| 4,700,405 | 10/1987 | Sternberg | 2/20 X |
| 4,748,690 | 6/1988 | Webster | 2/20 X |
| 4,757,555 | 7/1988 | Gold | 2/16 |
| 4,768,234 | 9/1988 | Yamamoto | 2/16 X |
| 5,168,578 | 12/1992 | Stanley | 2/20 X |
| 5,214,799 | 6/1993 | Fabry | 2/20 X |
| 5,557,803 | 9/1996 | Granich et al. | 2/16 |
| 5,581,809 | 12/1996 | Mah | 2/20 |

FOREIGN PATENT DOCUMENTS 2492265 4/1982 France .

OTHER PUBLICATIONS

Photocopy of Louisville TPS glove, date unknown.

*Primary Examiner*—Michael A. Neas

*Attorney, Agent, or Firm*—Leydig, Voit & Mayer, Ltd.

[57] ABSTRACT

A protective batting glove including padding in critical hand areas. The padding is a thin, shock absorbing material covering the hand areas that are susceptible to injury during batting. These critical hand areas include portions of both the upper and lower palmar side of the hand, portions of the digits, and a portion of the thumb. In additions, certain other critical areas have the shock absorbing material wrap around the hand, from the palmar surface to the dorsal surface. Non-critical hand areas are not padded to maximize tactile sensation and control.

7 Claims, 4 Drawing Sheets

PROTECTIVE BATTING GLOVE

FIELD OF THE INVENTION

The present invention relates generally to a protective batting glove for use in baseball, softball, and the like.

DISCLOSURE DOCUMENT

The present invention was disclosed in a disclosure document filed on or about May 9, 1995 and assigned Disclosure Document No. 376227.

BACKGROUND OF THE INVENTION

Baseball is an immensely popular American game, known as the "national pastime," played between two teams of nine players each. The basic implements used in the game are a leather-covered ball, bats for hitting the ball, and gloves (also called "mitts") for catching it. Baseball is played in more than 100 countries, but it thrives most in the United States both as a participant's and spectator's sport. At the highest level (in the United States and two Canadian cities), 26 teams make up the American and National Leagues (each with two divisions, East and West). Combined, these leagues are called major-league (professional) baseball.

Baseball's popularity is in part a result of the fact that almost every American boy plays the game at one time or another, and the lore of the game is intertwined with American life. Most players who reach the major leagues have worked their way up through Little League, scholastic, college, and minor-league (professional) ball.

Softball is a popular alternative to baseball for women at the elementary school, high school and college levels, and, for the first time, will be an Olympic sport during the 1996 Summer Olympics held in Atlanta, Ga. Softball is played on a smaller field, and with the same basic equipment as that used in baseball. Fast pitch and slow pitch are the two styles of softball. Most softball played is the slow pitch game. The ball is pitched slowly in a high arc, making it an easy target for hitters. Thus the emphasis in the slow-pitch game is on hitting and on defensive abilities.

There now are men's and women's professional softball leagues, as well as regional leagues with national tournaments. About 30 million adults and children played some form of competitive or recreational softball in the United States in the mid-1980s, making it one of the largest team sports in the country.

Baseball (and softball) has supplied the American culture with a wide range of legendary heroes, as well as books, magazines, movies, and songs. The game has contributed hundreds of words and phrases to the American language.

Baseball (and softball), at its most fundamental level, requires only a bat (tapering cylinder of wood), a ball (usually a multilayered sphere covered with hide), and a place to play. The playing field is usually marked with four (4) bases, with space in-between, which make up the infield. The outfield lies around a portion of the infield. Once the ball is pitched, the batter attempts to drive it along a path that will elude the defensive players. The defending players try to catch the ball and advance it to a base before the batter, or a runner, reaches a particular base. Both the batter and runners may advance as far as possible on any hit. A one-base hit is a single, a two-base hit a double, a three-base hit a triple, and a four-base hit a home run.

To the original equipment of a bat and a ball, a glove was soon added as a necessary piece of equipment in order to protect a defending player's hand and facilitate the catching of the ball. Over the years, as the games of baseball and softball evolved, so did the players' equipment.

Today, competition requires considerably more specialized equipment, either for protection or to enhance an athlete's performance. The defending players wear a leather glove on one hand. The catcher's glove, the largest, is wider and less flexible than other fielding gloves, and is heavily padded. The first baseman's mitt is more flexible and has one compartment for the thumb and another for the other fingers. The remaining players use gloves with separate compartments for each finger and a webbing between the thumb and index finger. At the plate, a batting helmet is worn, while the catcher wears a mask to protect the face, a chest protector for the body, and shin guards to protect the legs and feet.

The ball consists of three layers: a cork-and-rubber sphere forms the central core; woolen yarn is then tightly wound around the core; and a leather casing is stitched together around the whole. The bat, is round. It is made of wood, aluminum, or a comparable metal alloy.

Hits come in many forms: deliberately gentle bunts to unreachable parts of the infield, hard-hit ground balls that travel between the infielders, bloopers popped in an arc beyond the infield but out of the outfielders' reach, line drives in front of or between the outfielders, and clouts smashed over the fence. Catching the hits, and fielding the ball, involves constant use of the hands.

In more recent years, baseball and softball players have demanded more protection for chronic problems that have existed with protection of the hands. The hands are known to be 25 times more sensitive than other parts of the body, and, in baseball and softball, subject to risk of injuries such as bruises, contusions, stress fractures, and the like. Particular areas of the hand are most susceptible to injury depending on the position being played (i.e., catching or batting), and the susceptible areas differ significantly depending on player position. While protection from injury is of paramount importance, often it must be weighed against a player's ability to feel, and thus control, the ball.

When catching, in spite of the protection afforded defensive players in the form of specialized gloves (developed for various positions), the padding in the gloves was found to quickly break down from the repeated impact of the ball, and players were prone to bruises and fractures in area of ball impact on the hand. Increased padding in the areas of ball impact, however, lessened tactile sensation, and inhibited ball control. To overcome these problems, while increasing hand protection, protective inner gloves were developed. Webster, U.S. Pat. No. 4,748,690, provides an inner glove specifically designed to be worn inside a baseball or softball mitt. The shock absorbing padding in the critical areas protects the hand from injury, while permitting ball control through tactile sensation.

For batting, batting gloves have been developed to provide hand protection. Batting gloves were less critical in the past, when wooden bats were primarily used. More recently, aluminum and metal-alloy bats have been adopted for use in baseball and softball. These metal bats have much diminished shock absorbing properties in contrast to the wooden bats. When using a metal bat, the shock of the impact when the bat hits the ball is largely passed on to the batter, increasing the impact to the hands. The impact of any bat with the ball transmits shock and vibration to the soft tissue and the bones of the hand which can injure the hand. A rotation momentum is also imparted to the bat on contact with the ball which causes the bat to both exert force across and around a batter's hand, especially through the area between the thumb and index finger, and impart a shear force to the palmar side of the hand. In addition, with impact, the heel of the bat is shoved into the lower part of the palm of the hand, which can cause further injury.

To protect their hands during batting, many baseball and softball players now wear at least one thin leather glove. These tight fitting leather gloves used by batters offer a better grip, but very little protection from the stings, bruises and other hand injuries that occur after the wood or metal bats make contact with the ball.

Stanley, et al., U.S. Pat. No. 4,561,122, although originally designed for batting, is a protective glove that is being used for catching and batting, but the Stanley glove does neither. The open-fingered format makes the Stanley glove difficult to insert, and keep in place, when attempting to use it with an outer glove (i.e., mitt). Moreover, it does not provide for the critical areas of hand protection. Its use as a batting glove emphasizes the finger-tip feel needed in the proper grip of the bat, but it lacks the better gripping surface that a full-fingered glove provides. Further, it fails to protect other critical hand areas susceptible to injury during batting because these areas do not need protection with catching. In trying to be an overall glove, it falls short of being adequate for either catching or batting.

Other batting gloves are marketed by Louisville Glove Company, of Louisville, Ky., Easton Glove Company, of Burlingame, Calif. and Franklin Glove Company, of Stoughton, Mass. These batting gloves, like the Stanley glove, have substantial deficiencies. Louisville makes two gloves—the Louisville Slugger TPS and the Louisville TPX-Pro Sting Stop. Easton sells its VRS glove and its MIP glove. Franklin provides a batting glove. Each of these gloves, while providing protection, minimizes the protection by only providing protection on certain areas—typically the palm surfaces of the index finger and thumb, and the upper palm of the hand. Critical hand areas of rotational impact are left unprotected by these gloves, as well as areas which are subject to the impact of the heel of the bat. Thus, the wearer's hand is subject to injury in spite of the use of these gloves.

Accordingly, there exists a definite need for a batting glove which provides protection to all of the critical areas of the hand which are susceptible to injury during batting. There also exists a need for a batting glove which provides maximum protection during batting. There exists a further need for a batting glove which allows for the batter's hand to have maximum tactile sensation when wearing the batting glove. The present invention satisfies these and other needs and provides further related advantages.

OBJECTS AND SUMMARY OF THE INVENTION

The present invention relates to a protective batting glove for use when playing baseball, softball, and the like.

When a batter bats, he swings the bat and contact is made with the ball. The impact of the bat with the ball is transmitted through the bat to the hand or hands, which absorb much of the shock and vibration in both the soft tissue and the bones of the hand thereby causing injury to the hand. The impact of the bat with the ball imparts a rotation momentum to the bat which causes the bat to exert force across and around the hands of the batter from the palmar side of the hand toward the dorsal side of the hand, and imparts a sheer force to the palmar side of the hand. Then, with the impact, the heel of the bat is shoved into the lower part of the palm of the hand, which can cause further injury to the hand.

The present invention overcomes the drawbacks of the prior art in that it provides protective padding in all of the hand areas which are susceptible to injury during batting. The present invention affords maximum hand protection to the batter. While providing the comprehensive hand protection needed by the batter, the present invention also maximizes tactile sensation to allow for bat control.

The present invention provides a closed-fingered protective batting glove. The protective batting glove of the present invention is characterized by having padding in the critical hand areas. The padding is a thin, shock absorbing material covering the hand areas that are susceptible to injury during batting. These critical hand areas include portions of both the upper and lower palmar side of the hand, portions of the digits, and a portion of the thumb. In addition, certain other critical areas have the shock absorbing material wrapping around the hand, from the palmar surface to the dorsal surface. Non-critical hand areas are not padded to maximize tactile sensation and control.

It is an object of the present invention to provide a closed-fingered protective batting glove.

Another object of the present invention is to provide thin, shock absorbing material covering the hand areas that are susceptible to injury during batting.

Yet another object of the present invention is to provide protective covering to all of the critical hand areas of a batter.

Still another object of the present invention is to allow for maximum tactile sensation and control during batting.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

The aspects of the present invention will be apparent upon consideration of the following detailed description taken in conjunction with the accompanying drawings, in which like reference characters refer to like parts throughout, and in which.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

The protective batting glove of the present invention maximizes hand protection, while providing for flexibility and tactile sensation needed for batting control.

Figure 1:
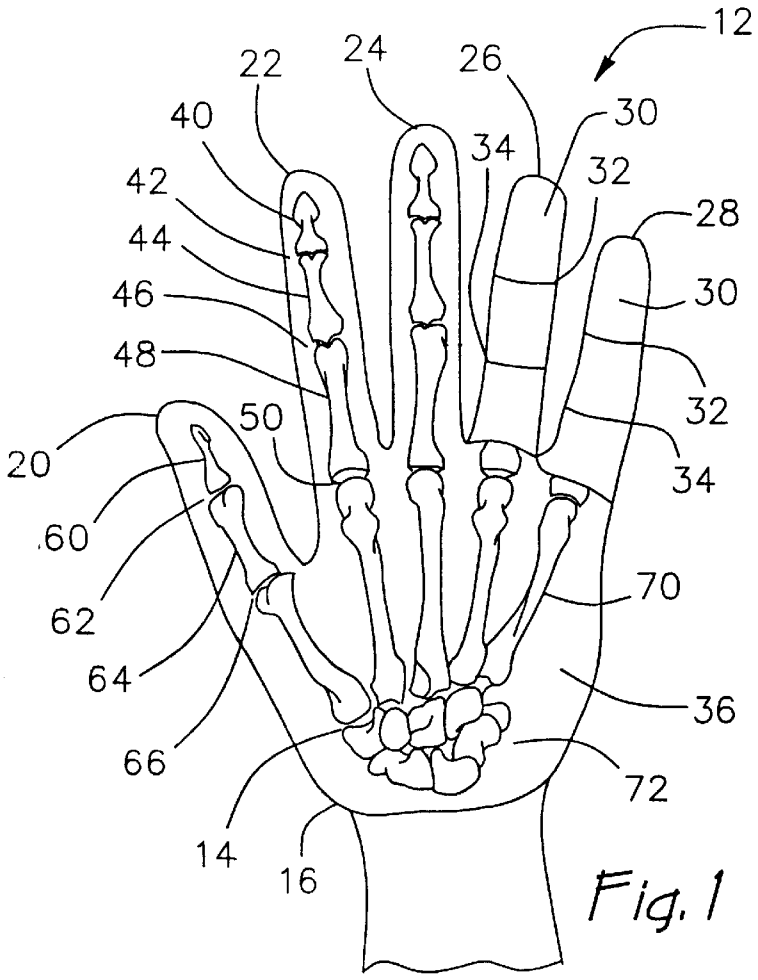
FIG. 1 illustrates a palmar surface view of a hand skeleton, outlined with the shape of the hand, and overlaid with the hand surface on the fourth and fifth digits.

Referring to FIG. 1, there is shown a exemplary hand 12, with skeletal detail, of a batter who would use the device of the present invention. FIG. 1 depicts the palmar surface, or palm side, of a hand skeleton 14 outlined with the shape of the hand 16. The hand skeleton 14 is overlaid with the hand surface 30 on the fourth digit 26 and fifth digit 28. The crease lines 32 and 34, of the fourth digit 26 and fifth digit 28, are also shown. The hand skeleton 14 has the two digits (index finger and middle finger)—second digit 22 and third digit 24, with critical areas which are subject to stress and injury during batting.

Referring now to the second digit 22 of FIG. 1, the hand skeleton 14 of the second digit 22 has various parts identified. These parts are exemplary of all of the second, third, fourth and fifth digits, 22, 24, 26, and 28, respectively, of the hand. The distal phalanges 40 is that portion of the bone above the bone joint closest to the end of a digit. The bone joint closest to the end of a digit is the distal phalangeal joint 42. Moving inward toward the palm 36 of the hand 12, the next joint of a digit is the middle phalangeal joint 46. The bone between the distal phalangeal joint 42 and the middle phalangeal joint 46 is the middle phalanges 44. The palmar metacarpophalangeal joint 50 is located within the hand just below the approximate intersection of a digit with the palm 36 of the hand 12. Between the middle phalangeal joint 46 and the metacarpophalangeal joint 50 is the proximal phalanges 48.

Referring now to the first digit 20 of FIG. 1, the hand skeleton 14 of the first digit 20 has various parts identified. The distal phalanges 60 is that portion of the bone of the first digit 20 above the bone joint closest to the end of the digit. The bone joint closest to the end of the first digit 20 is the interphalangeal joint 62. Moving inward toward the palm 36 of the hand 12, the next joint of the first digit 20 is the metacarpal phalangeal joint 66. The bone between the interphalangeal joint 62 and the metacarpal phalangeal joint 66 is the proximal phalanges 64.

Referring, again, to FIG. 1, in the palm 36 there is shown the metacarpal bones 70 and the carpal bones 72.

Figure 6:
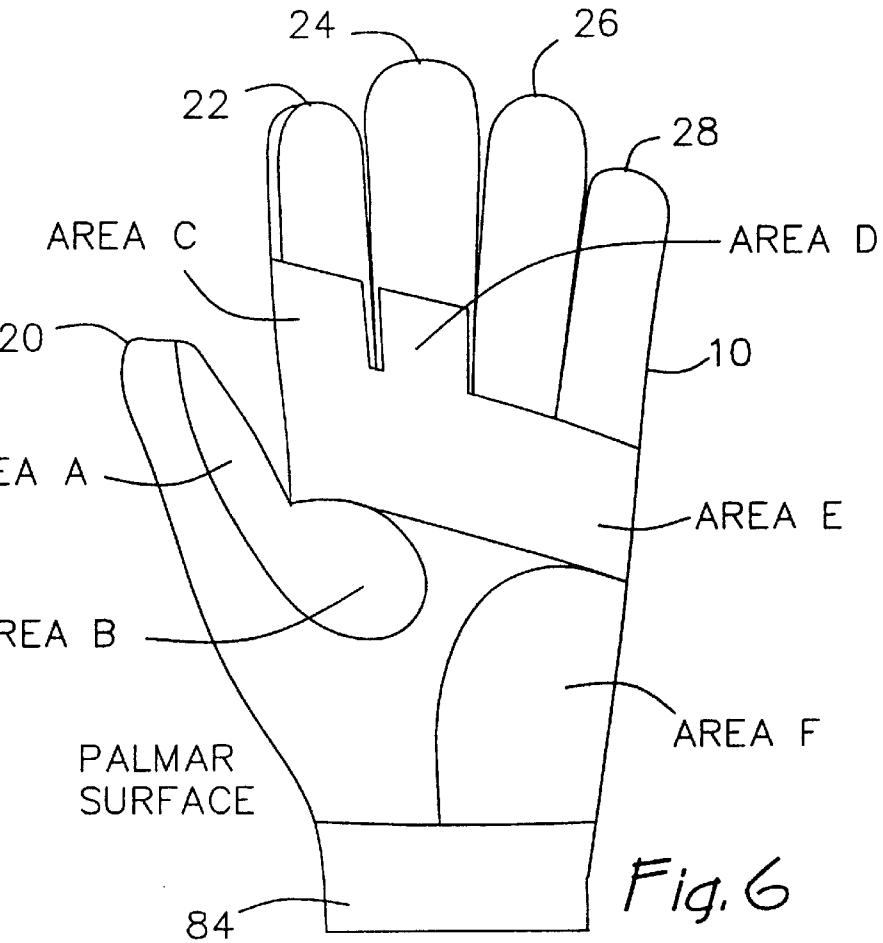
FIG. 6 shows the palmar surface of a preferred embodiment of the present invention depicting critical areas of the palmar surface, including those that wrap around from the dorsal surface.
Figure 5:
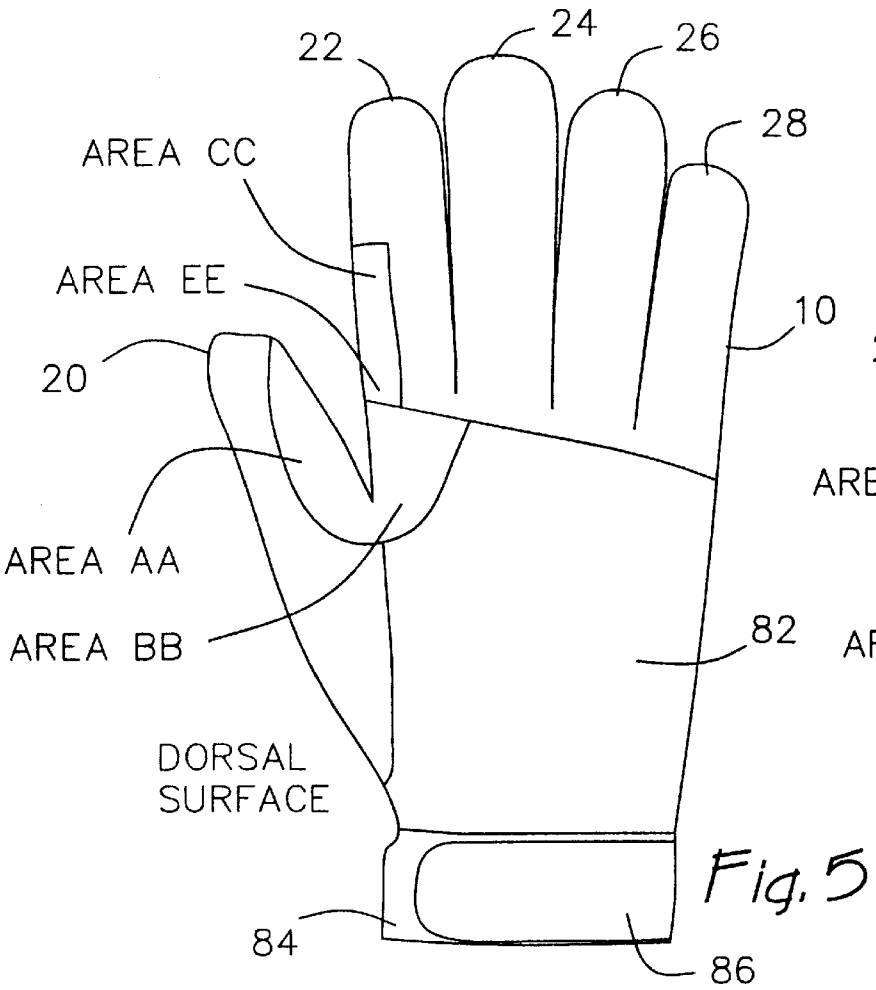
FIG. 5 shows the dorsal surface of a preferred embodiment of the present invention depicting critical areas of the dorsal surface which wrap around from the palmar surface.
Figure 7:
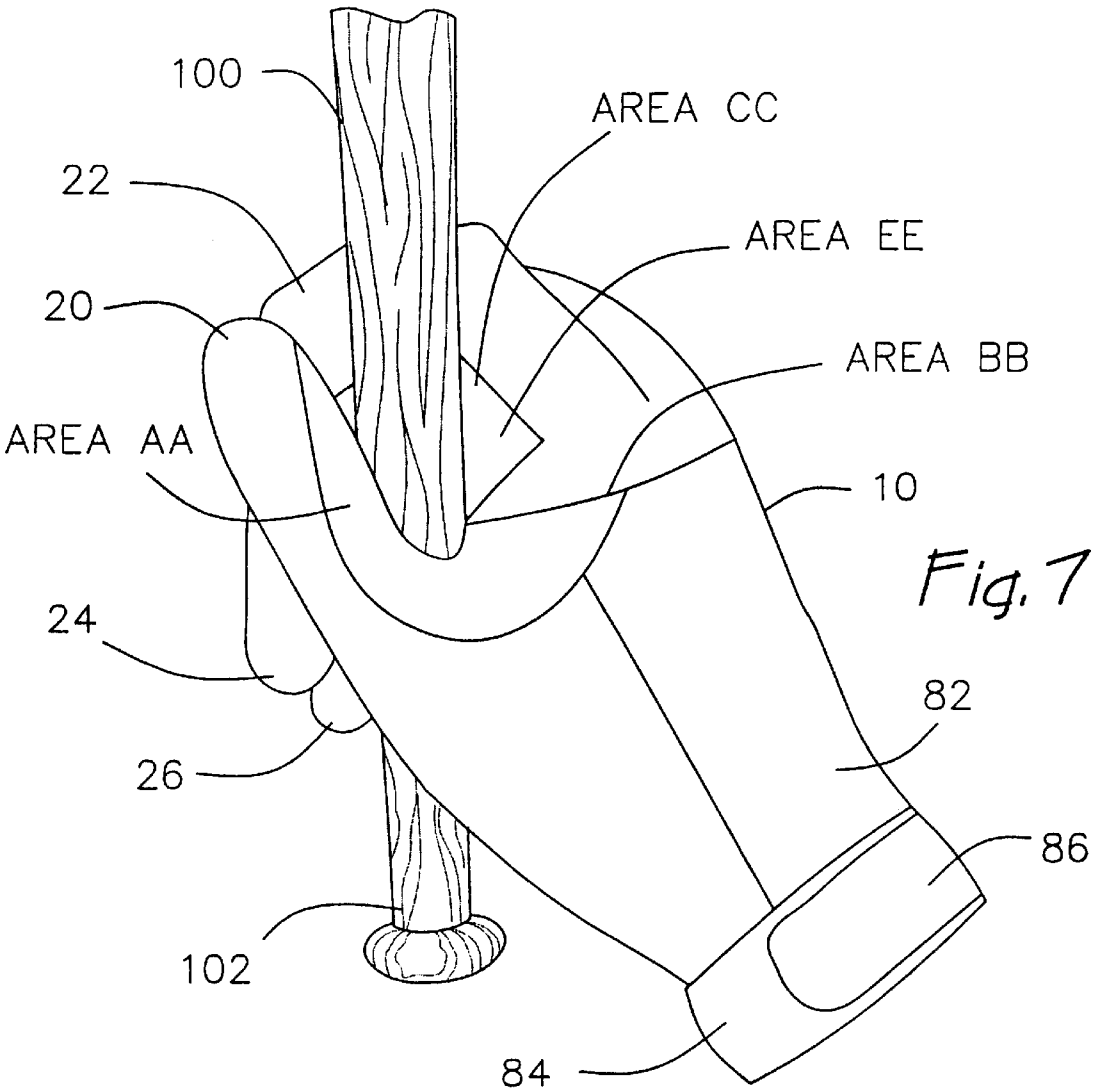
FIG. 7 illustrates a perspective view of a preferred embodiment of the present invention exemplary of its use by a batter holding a bat.

Three views of a preferred embodiment of the protective batting glove 10 of the present invention are shown in FIGS. 5, 6, and 7. In FIG. 5 the dorsal surface or outer surface is shown. FIG. 6 depicts the palmar surface, or inner (palm) surface of the protective batting glove 10. When batting, the batter grips the bat using the protective batting glove 10 as shown in FIG. 7. The digits, 20, 22, 24, 26 and 28 (28 is not shown in FIG. 7) of the protective batting glove 10 wrap around the bat 100. The heel 102 of the bat 100 is aligned with the lower part of the palm 36 (not shown).

Using his hands alone (without the protective batting glove 10 of the present invention), when the batter swings the bat 100, and contact is made with the ball (not shown), the impact of the bat with the ball is transmitted through the bat 100 to the hand 12 (not shown) which is caused to absorb much of the shock and vibration in both the soft tissue and the bones of the hand 12. The impact of the bat with the ball imparts both a rotation momentum to the bat which causes the bat to exert force across and around the hands of the batter from the palmar side of the hand toward the dorsal side of the hand, particularly in the area between the first digit 20 and the second digit 22, and a shear force to the palmar side of the hand.

Referring to FIG. 7 depicting the protective batting glove 10 in use, and generally also to FIGS. 5 and 6, the critical areas of the hand 12 (not shown in FIGS. 5, 6, or 7) which need to be protected from injury during batting are defined on the protective batting glove by AREAS A through F, and AREAS AA, BB, CC, and EE. A shock-absorbing padding is used to cover

- the areas (comprising Area C and Area CC, and Area D) of the second digit 22 and third digit 24 closest to the palm 36 of the hand 12,
- and the area (comprising Area E and Area EE) which begins below the fifth digit 28 (Area EE covering the four palmar metacarpophalangeal joints 50) and extending past the second digit 22 to wrap around to the dorsal side of the hand 12 (Area EE),
- as well as areas (comprising Area A and Area AA, and Area B and Area BB) on the first digit 20, which extend downward toward the palm 36 (not shown), and from the palmar side of the first digit 20 (Area A and Area B) around to the dorsal side of the first digit 20 (Areas AA and BB), respectively, which receive much of the initial shock and vibration when the batter swings and hits the ball. Then, with the impact, the heel 102 of the bat 100 is caused to be pushed into the lower part of the palm 36 (not shown), this area (Area F) is another critical area of the hand 12 and it is also protected with shock-absorbing material.

Areas A through F, and Areas AA, BB, CC and EE, are collectively referred to as the padding overlay areas 80 (shown in FIGS. 2, 3, and 4) which overlay the critical areas of the hand 12. The padding overlay areas 80 each preferably overlay at least a critical area of the hand 12.

Figure 2:
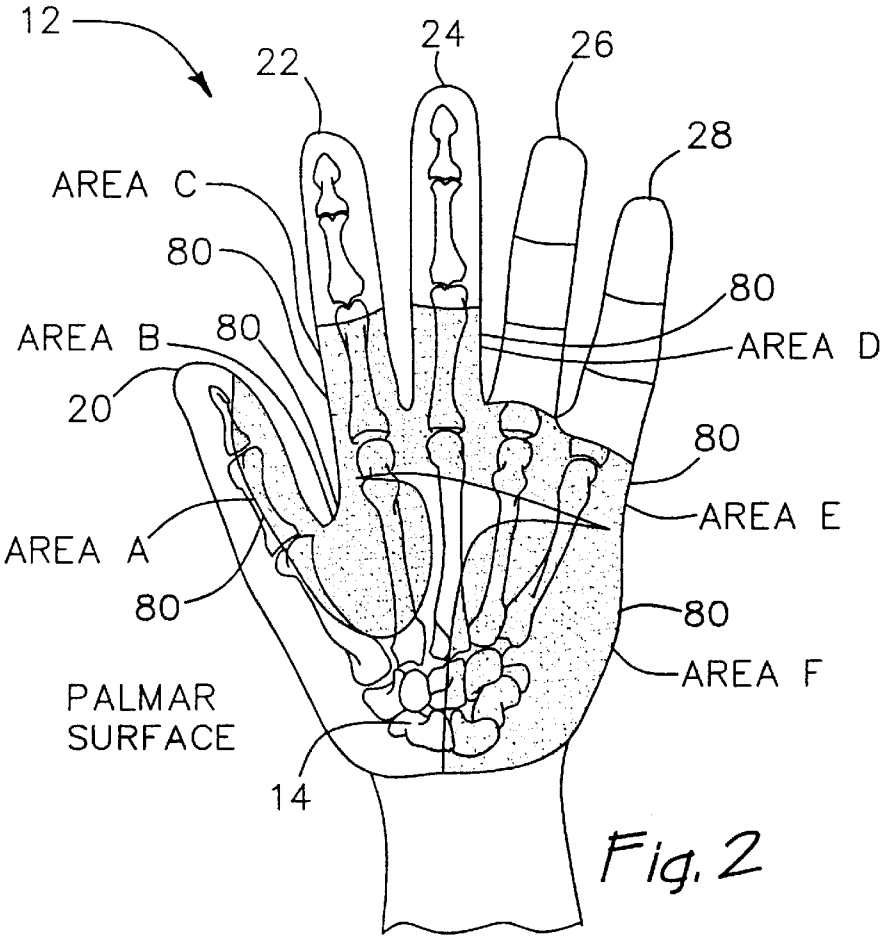
FIG. 2 depicts the palmar surface view of FIG. 1, having a hand skeleton, outlined with the shape of the hand, overlaid with the hand surface on the fourth and fifth digits, and showing critical palmar areas susceptible to injury during batting, while showing the hand skeleton.
Figure 4:
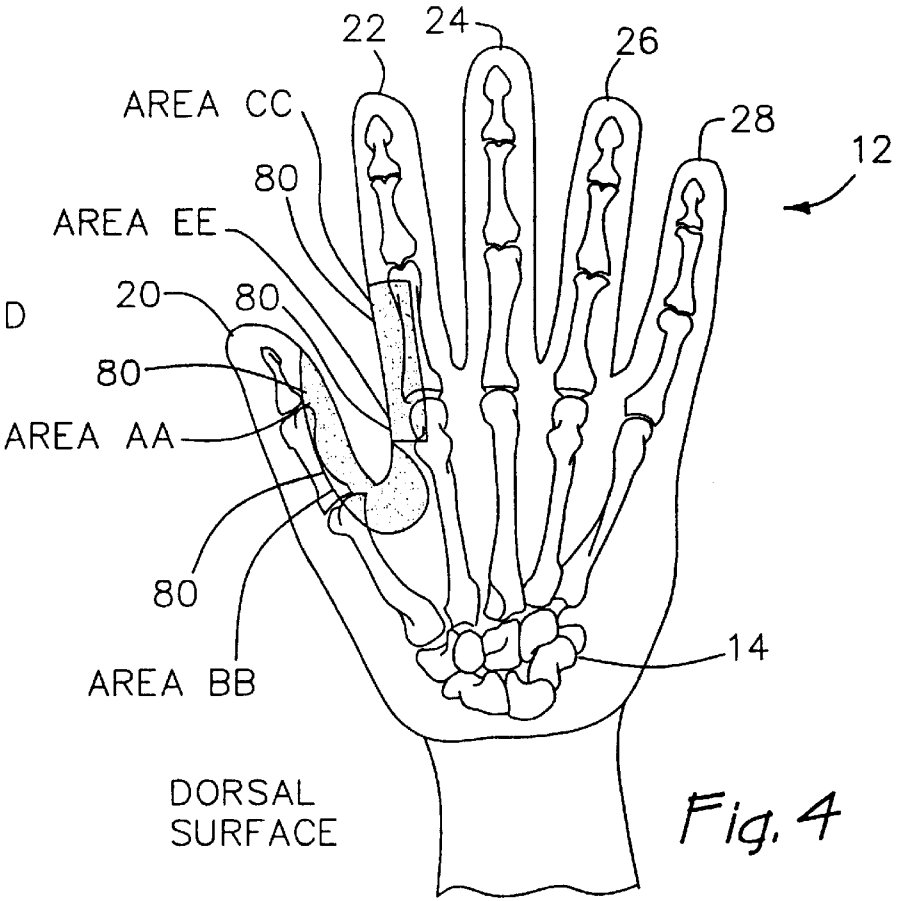
FIG. 4 illustrates a dorsal surface view of a hand skeleton, outlined with the shape of the hand, overlaid with the hand surface on the fourth and fifth digits, and showing critical areas susceptible to injury during batting.
Figure 3:
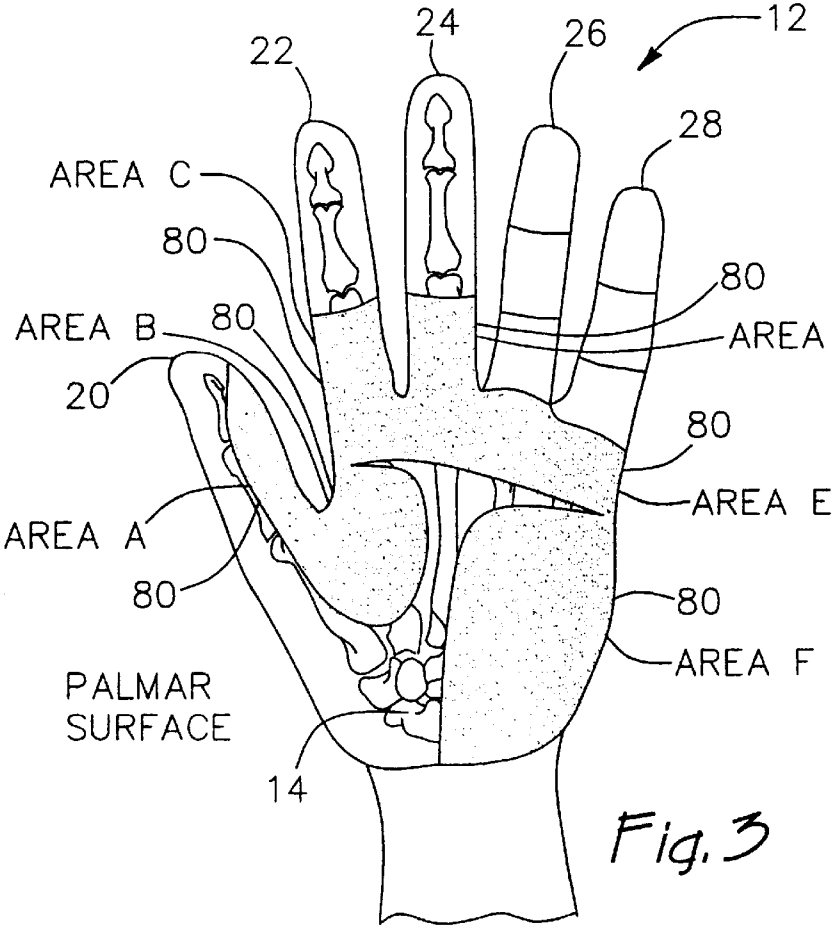
FIG. 3 depicts the palmar surface view of FIG. 2, having a hand skeleton, outlined with the shape of the hand, overlaid with the hand surface on the fourth and fifth digits, and overlaid with critical palmar areas susceptible to injury during batting.

Using as a basis the exemplary hand 12, with skeletal detail shown in FIG. 1, FIGS. 2, 3, and 4 further show the location of the shock-absorbing padding of the protective batting glove 10 (not shown) depicted as padding overlay areas 80 on the hand 12. FIG. 2 further shows the palmar side of the padding overlay areas 80 of the critical areas of the hand 12, that is, each padding overlay covers at least a critical area (or may cover portions thereof)—that is, an area which is susceptible to injury when batting. In FIG. 2, the overlay of the critical areas of the hand 12 identifies the critical areas of the palmar side of the hand 12 which are covered by thin, shock absorbing material, with the hand skeleton 14 caused to be shown in addition to the critical areas so that the overlay areas 80 on the palmar side of the hand 12 can be viewed, as well as described herein. FIG. 3 provides the same view as FIG. 2, with the padding overlay areas 80 blocking the view of the hand skeleton 14. FIG. 4 shows the overlay of the critical areas of the hand 12 from the dorsal surface. The overlay areas 80 of the dorsal surface wrap around the hand 12 from the view of the palmar side shown in FIG. 3.

Referring to FIG. 3 depicting the hand 12, and to FIG. 6 depicting the protective batting glove 10, and to FIG. 1 for skeletal reference, there is shown Area F which is a padding overlay area 80 covering the lower portion of the palm 36 substantially at the location of the metacarpal bones 70 and the carpal bones 72 of the fourth and fifth digits 26 and 28 and soft tissue at the base of the palmar side of the hand 12. Area C is a padding overlay area 80 covering the palmar surface of the proximal phalanges 48 of the second digit 22, and stopping just below the middle phalangeal joint 46. Area D is a padding overlay area 80 covering the palmar surface of the proximal phalanges 48 of the third digit 24 and stopping just below the middle phalangeal joint 46. Area A is a padding overlay area 80 covering the palmar side of the first digit 20 to protect the metacarpal phalangeal joint 66, proximal phalanges 64, interphalangeal joint 62, and part of the distal phalanges 60. Area B is a padding overlay area 80, shown on the palmar side of the hand 12, beginning from the base of the first digit 20 and covering the lower part of the metacarpal bone 70 of the second digit 22 just below the palmar metacarpophalangeal joint 50. Area E is a padding overlay area 80 beginning from under the fifth digit 28 at approximately the crease line that meets the hand, and extending to cover the area under the second digit 22. The padding overlay area 80 of Area E covers the palmar metacarpophalangeal joints 50 of the second through fifth digits 22, 24, 26, and 28, respectively, and protects the palmar metacarpophalangeal joints 50, and the soft tissue of the hands which covers these joints, from injury.

Referring to FIG. 4 depicting the hand 12, and to FIGS. 5 and 7 depicting the protective batting glove 10 (and FIG. 1 for skeletal reference), there is shown the padding overlay areas 80 of the dorsal side of the hand 12. Area CC is a continuation of AREA C (shown in FIGS. 3 and 6). AREA CC wraps around the hand 12 at the proximal phalanges 48 (shown in FIG. 1) of the second digit 22, covering a portion of the dorsal side of the second digit 22. Area AA is a padding overlay area 80 and a continuation of Area A (shown in FIGS. 3 and 6) covering a part of the dorsal side of the first digit 20 to protect the inner dorsal side of the distal phalanges 60, interphalangeal joint 62, and proximal phalanges 64. Area BB wraps around the hand 12 beginning from the end of Area B (shown in FIGS. 3 and 6) and across the area of the hand 12 between the first digit 20 and the second digit 22, to the dorsal side of the hand 12. Area EE begins at end of the palmar portion of Area E below the second digit 22, and extends around the hand 12 to cover a portion of the dorsal side of the second digit 22 above the metacarpophalangeal joint 50 of the second digit 22.

The protective shock-absorbing material of the padding overlay areas 80 is preferable approximately 1/16" to 3/32" in thickness, but this range may vary according to the needs of the individual batter, and the nature of the shock-absorbing material used. In a preferred embodiment of the present invention, the shock-absorbing materials is vinyl nitril made by Monarch Rubber of Baltimore, Md.

Referring to FIGS. 5 and 6, there is shown a preferred embodiment of the protective batting glove 10 of the present invention. The shock-absorbing material is affixed to the glove in the overlay areas 80 with glue or other suitable means. The shock-absorbing material is then preferably covered with another layer of thin leather which is sewn to the glove.

The material of construction of the protective batting glove 10 can be leather, or other suitable material. For snugness of fit, portions of the protective batting glove 10 may be constructed of Spandex® or other stretch material. Such areas should be those areas where padding is not required, such as a portion 82 of the outer side of the protective batting glove 10 shown in the dorsal surface view of FIG. 5. To further secure the protective batting glove 10, an elastic band 84, or the like, is used around the base of the protective batting glove 10. The band 84 may be provided with a Velcro® or similar fastener 86 to loosen the protective batting glove 10 for removal, while allowing the protective batting glove 10 to be secured in place during use. Such elastic bans 84 and fasteners 86 are well known.

As a result of the padding of all of the critical areas of the present invention with thin, shock-absorbing padding, the present invention allows for proper grip and fingertip feel while offering protection in the critical areas of the batter's hand.

Although the structure of the present invention has been described with protective padding at specific locations, it is not intended that the invention be so limited. Various modifications of the described embodiments of the invention specifically illustrated and described herein will be apparent to those skilled in the art, particularly in light of the teachings of this invention. It is intended that the invention cover all modifications and embodiments which fall within the spirit and scope of the invention. Thus, while preferred embodiments of the present invention have been disclosed, it will be appreciated that it is not limited thereto but may be otherwise embodied within the scope of the following claims.

I claim as my invention:

1. A batting glove receiving the thumb and forefingers of a hand and comprising:

a palmar side for covering a palm of a hand;

a dorsal side for covering a dorsal side of the hand, the glove further including first, second, third, fourth, and fifth digital portions for receiving, respectively, the thumb and forefingers, the thumb and forefingers respectively comprising the first, second, third, fourth, and fifth digits of the hand, each of the first, second, third, fourth, and fifth digits, having multiple bones including a proximal phalanges adjacent the palm of the hand and joined to the palm of the hand at a palmar metacarpophalangeal joint and joined opposite the palm to a middle phalanges at a middle phalangeal joint, the palm of the hand including multiple metacarpal bones and carpal bones; and shock absorbing padding attached to and covering selected separated areas of the glove to dissipate mechanical shock propagated through a bat gripped with the glove, while maintaining glove flexibility and tactile communication with the bat, wherein the shock absorbing padding covers a first area including a portion of the palmar side extending from the fifth digit to the second digit, opposite and covering the metacarpophalangeal joints of the fifth through second digits of a hand in the glove, extending along only part of the second digital portion, opposite and covering the proximal phalanges to the middle phalangeal joint of the second digit of a hand in the glove, and extending along only part of the third digital portion, opposite and covering the proximal phalanges to the middle phalangeal joint of the third digit of a hand in the glove.

2. The batting glove according to claim 1 wherein the first area extends from the second digital portion on the palmar side to part of the second digital portion on the dorsal side, opposite the first digital portion.

3. The batting glove according to claim 1, the first digit of the hand including a distal phalanges joined at an interphalangeal joint to the proximal phalanges, wherein the shock absorbing padding covers a second area, separate from the first area, on the first digital portion opposite the metacarpophalangeal joint, proximal phalanges, interphalangeal joint, and part of the distal phalanges of the first digit of a hand in the glove, the second area extending onto parts of the palmar and dorsal sides of the glove.

4. The batting glove according to claim 3, wherein the shock absorbing padding covers a third area, separate from the first and second areas, opposite the metacarpal bones and carpal bones of the palm of a hand in the glove and a base of a hand in the glove, proximate an edge of the palmar side remote from the first digital portion.

5. A batting glove receiving the thumb and forefingers of a hand and comprising:

a palmar side for covering a palm of a hand;

a dorsal side for covering a dorsal side of the hand, the glove further including first, second, third, fourth, and fifth digital portions for receiving, respectively, the thumb and forefingers, the thumb and forefingers respectively comprising the first, second, third, fourth, and fifth digits, of the hand, each of the first, second, third, fourth, and fifth digits having multiple bones including a proximal phalanges adjacent the palm of the hand and joined to the palm of the hand at a palmar metacarpophalangeal joint and joined opposite the palm to a middle phalanges at a middle phalangeal joint, the palm of the hand including multiple metacarpal bones and carpal bones; and shock absorbing padding attached to and covering selected separated areas of the glove to dissipate mechanical shock propagated through a bat gripped with the glove, while maintaining glove flexibility and tactile communication with the bat, wherein the shock absorbing padding covers a first area including a portion of the palmar side (i) extending from the fifth digit to the second digit, opposite and covering the metacarpophalangeal joints of the fifth through second digits of a hand in the glove, (ii) extending along only part of the second digital portion, opposite and covering the proximal phalanges to the middle phalangeal joint of the second digit of a hand in the glove, and (iii) extending along only part of the third digital portion, opposite and covering the proximal phalanges to the middle phalangeal joint of the third digit of a hand in the glove and a second area, separate from the first area, opposite the metacarpal bones and carpal bones of the palm of a hand in the glove and a base of a hand in the glove, proximate an edge of the palmar side remote from the first digital portion.

6. The batting glove according to claim 5, wherein the first area extends from the second digit on the palmar side to part of the second digit on the dorsal side, opposite the first digit.

7. A batting glove receiving the thumb and forefingers of a hand and comprising:

a palmar side for covering a palm of a hand;

a dorsal side for covering a dorsal side of the hand, the glove further including first, second, third, fourth, and fifth digital portions for receiving, respectively, the thumb and forefingers, the thumb and forefingers respectively comprising the first, second, third, fourth, and fifth digits, of the hand, each of the first, second, third, fourth, and fifth digits having multiple bones including a proximal phalanges adjacent the palm of the hand and joined to the palm of the hand at a palmar metacarpophalangeal joint and joined opposite the palm to a middle phalanges at a middle phalangeal joint, the palm of the hand including multiple metacarpal bones and carpal bones and the first digit of the hand including a distal phalanges joined at an interphalangeal joint to the proximal phalanges; and shock absorbing padding attached to and covering selected separated areas of the glove to dissipate mechanical shock propagated through a bat gripped with the glove, while maintaining glove flexibility and tactile communication with the bat, wherein the shock absorbing padding covers a first area opposite the metacarpal bones and carpal bones of the palm of a hand in the glove and a base of a hand in the glove, proximate an edge of the palmar side, remote from the first digital portion and a second area, separate from the first area, on the first digital portion opposite and covering the metacarpophalangeal joint, proximal phalanges, interphalangeal joint, and part of the distal phalanges of the first digit of a hand in the glove, the second area extending onto parts of the palmar and dorsal sides of the glove.

* * * * *